US005933117A

United States Patent [19]

Gerhard

[11] Patent Number: 5,933,117

[45] Date of Patent: Aug. 3, 1999

[54] FLEXIBLE FERRITE LOADED LOOP ANTENNA ASSEMBLY

[75] Inventor: Erich Max Gerhard, South Kingstown, R.I.

[73] Assignee: The United States of America as represented by the Secretary of the Navy, Washington, D.C.

[21] Appl. No.: 08/696,586

[22] Filed: Jul. 24, 1996

[51] Int. Cl.[6] ..... H01Q 1/34; H01Q 7/08

[52] U.S. Cl. ..... 343/709; 343/895; 343/788

[58] Field of Search ..... 343/709, 895, 343/787, 788; H01Q 1/34, 7/08

[56] References Cited

U.S. PATENT DOCUMENTS

| | | | |
|---|---|---|---|
| 4,376,941 | 3/1983 | Zenel | 343/709 |
| 4,774,519 | 9/1988 | Pease et al. | 343/709 |
| 4,978,966 | 12/1990 | Takizawa et al. | 343/788 |
| 5,517,202 | 5/1996 | Patel et al. | 343/709 |

*Primary Examiner*—Hoanganh Le

*Attorney, Agent, or Firm*—Michael J. McGowan; Prithvi C. Lall; Michael F. Oglo

[57] ABSTRACT

A buoyant loop antenna, deployable along a cable, includes a core region comprising a plurality of annular ferrite beads. These annular shaped beads include a center hole and generally concave first end and a generally convex second end. The ferrite beads are aligned with the concave end of one bead against the convex end of another bead. This allows the cable to flex while the beads maintain contact with each other, providing flexibility and resistance to crushing. The core region has a loop wire wrapped helically around it, forming the loop antenna. The loop wire element starts and ends at the same end of the core region, forming a loop. This loop allows transmission and reception in and athwart (side to side) direction. This novel wire loop antenna can be combined with a straight wire antenna (which provides reception in a fore and aft direction) to provide an omni-directional cable antenna assembly.

19 Claims, 5 Drawing Sheets

FLEXIBLE FERRITE LOADED LOOP ANTENNA ASSEMBLY

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to a flexible ferrite loaded loop antenna assembly and more particularly, to a flexible antenna assembly that will permit VLF/LF reception in the athwart direction (side to side) relative to its deployment along a cable.

(2) Description of the Prior Art

Three types of antennas have been used by submarines for reception of radio signals in the very low frequency and low frequency (VLF/LF) transmission bands. The first is a mast mounted antenna which is omni-directional and extends above the ocean surface. Such an antenna is used when the submarine is not concerned with being detected. The second, a voltage probe antenna exists in the periscope and extends above the ocean surface. The third, a buoyant cable antenna, is used when the submarine is submerged and must avoid detection.

The buoyant cable antenna floats on the ocean surface and is deployed along with a buoyant cable. The buoyant cable antenna must be flexible because it is launched through a transfer mechanism which bends the cable through a six inch radius. Because flexibility is required, buoyant cable antennas have employed a horizontal wire antenna element which can receive only in the fore and aft (front and back) direction relative to its deployment. This limits the reception capability of the buoyant cable antenna.

Accordingly, there is a need for a buoyant cable antenna system with omni-directional capability that can be launched under all sea conditions at depth without danger of being detected. To achieve omni-directionality, such a buoyant cable antenna system requires the addition of a loop antenna that can receive VLF/LF in athwart direction relative to ship's heading. A buoyant cable mounted loop antenna must be capable of being bent through at least a six inch radius during deployment, and pass signals received on the wire antenna. Therefore, what is required is a buoyant cable antenna system including a flexible loop antenna which will provide the desired omni-directional signal reception and is compatible with existing deployment mechanisms.

SUMMARY OF THE INVENTION

This invention features a loop antenna deployable along a cable. The loop antenna has a core region comprising a plurality of cylindrical or annular ferrite beads. The annular shaped ferrite beads include a center hole and a generally concave first end and a generally convex second end, with a coaxial cable passing through the center hole. The ferrite beads are aligned with the concave end of one bead against the convex end of another bead. This allows the cable to flex while the beads maintain contact with each other. The ferrite beads of the core region are spring loaded to keep the ferrite beads in contact with each other, yet allowing the cable to bend and flex without harm during deployment.

The core region including the plurality of ferrite beads includes a loop wire element wrapped helically around it, forming the loop antenna. The loop wire element starts and ends at the same end of the core region.

This novel loop antenna can be combined with a straight wire antenna to provide an omni-directional cable antenna assembly. The straight wire antenna receives signals in the fore-aft (front to back) direction, while the loop antenna receives signals in the athwart (side to side) direction. The signal from the straight wire antenna is amplified by an amplifier, and then passes on the coaxial cable through the center of the loop antenna core region. The loop antenna signal is amplified by a second amplifier, then travels by twisted pair parallel with the coaxial cable, through a transmission cable back to the vessel.

In the preferred embodiment, the entire cable is buoyant to float on the surface of the ocean, and is sufficiently flexible to bend around a 6 inch radius during deployment. A submarine can therefore remain undetected underwater, yet receive radio transmissions on an omni-directional antenna.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
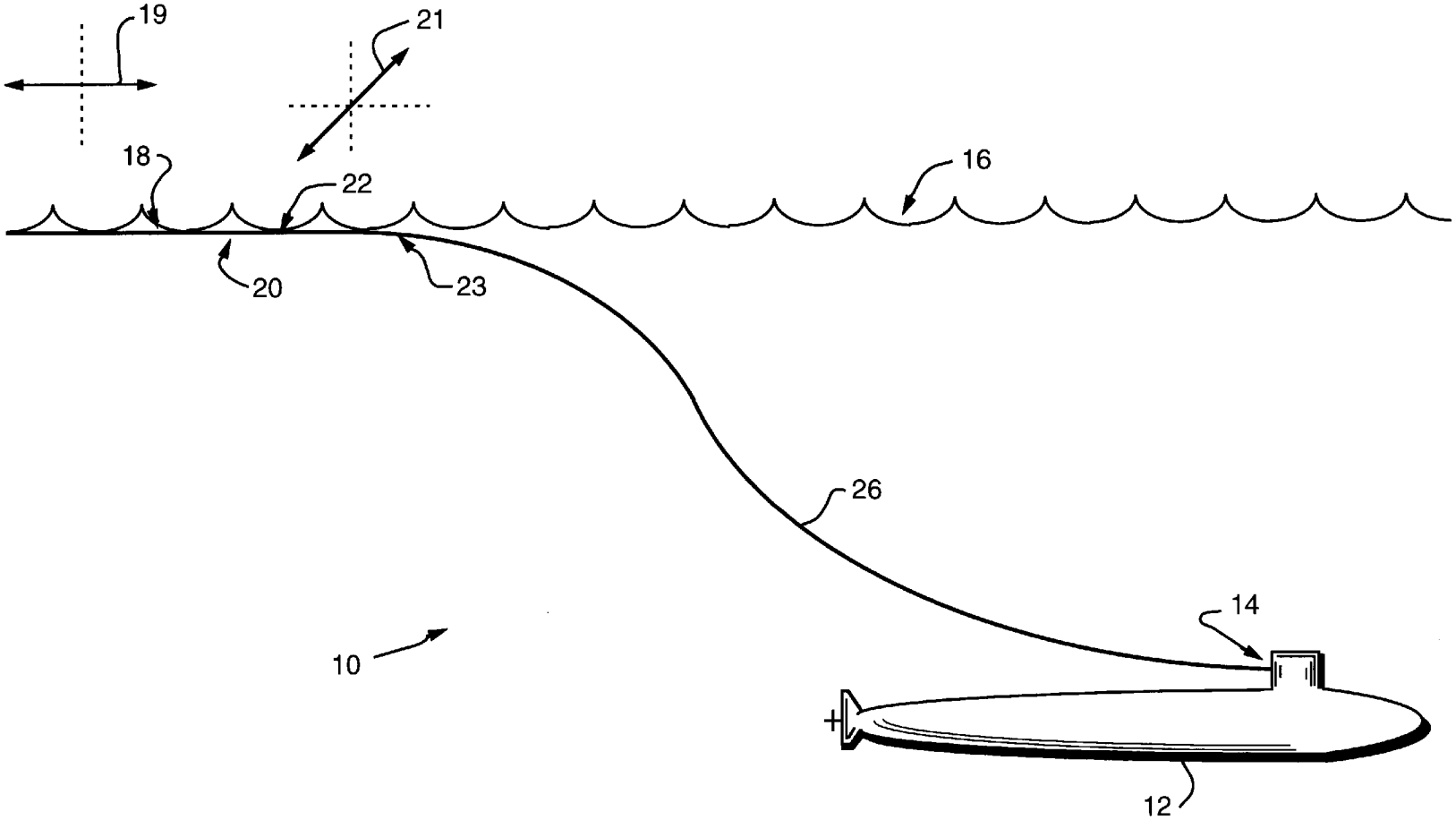
FIG. 1 is a schematic view of the deployable antenna cable assembly according to the present invention.

An omni-directional, buoyant, deployable cable antenna, assembly 10, FIG. 1, according to the present invention is deployable from a vessel such as submarine 12. Buoyant cable 10 is intended for use in the Navy buoyant cable antenna assembly used on submarines to receive VLF/LF (very low frequency/low frequency) signals. Buoyant cable 10 is deployed while the submarine is submerged, through the buoyant cable transfer mechanism 14 and it floats on the surface of the ocean 16, to allow reception of radio signals while avoiding detection of submarine 12 by sea or air vessels.

The present invention combines a standard prior art horizontal wire antenna element 18 which can receive radio transmissions in the fore and aft (front and back) direction as designated generally by arrow 19. Horizontal wire antenna element 18 is connected to amplifier 20 which boosts the signal from wire antenna element 18. The athwart loop antenna 22 provides reception in the athwart ship (side to side) direction as designated generally by arrow 21. The signal from loop antenna 22 is boosted by another amplifier 23. Both loop antenna 22 and horizontal wire antenna 18 are connected to a buoyant cable transmission line 26 which connects to submarine or other vessel 12. This allows the antenna assembly 10 to receive transmissions omni-directionally.

Figure 2:
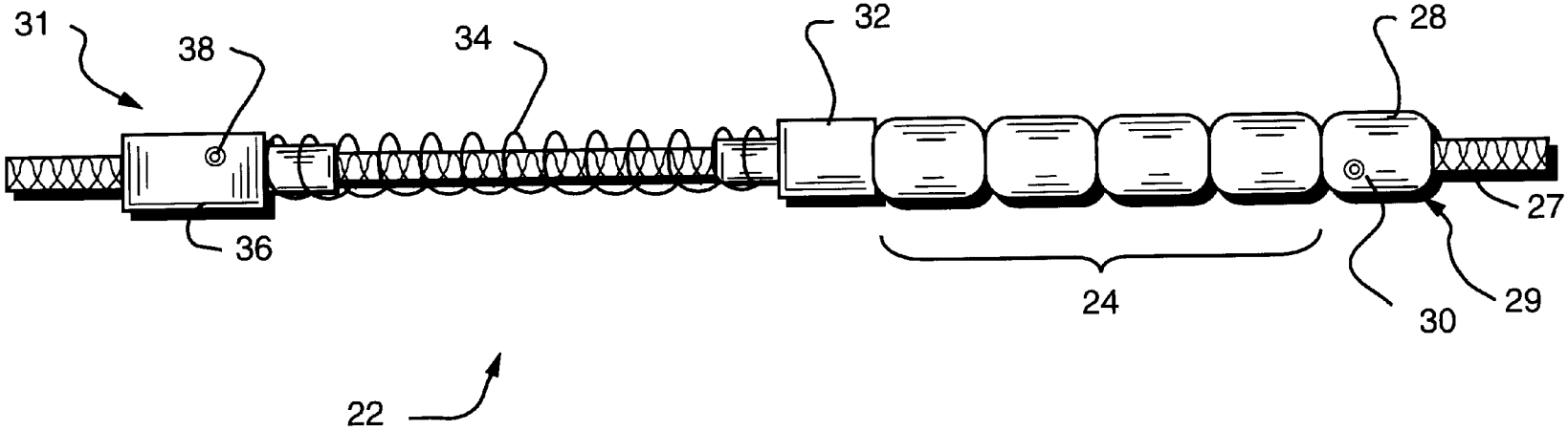
FIG. 2 is a sectional view of the athwart loop antenna portion of the deployable antenna assembly according to the present invention.

When the cable antenna assembly 10 is deployed, it is bent through a radius of 6 inches by transfer mechanism 14. Coaxial cable 27 FIG. 2, passes through the center of the loop antenna and carries the signal from the horizontal wire antenna amplifier to the ship or submarine. Surrounding coaxial cable 27 are ferrite beads 24 which form the center core of the loop antenna 22 and allow the athwart loop antenna to bend through a 6 inch radius. The ferrite beads are held captive proximate at least a first end 29 by fixed end retainer 28 which is secured to coaxial cable 27 by set screw 30. At the second end 31 of the loop antenna is fixed spring retainer 36 also secured to coaxial cable 27 by a set screw 38. Compression spring 34 is located between fixed spring retainer 36 and flexible spring retainer 32 which is proximate the ferrite beads 24. Compression spring 34 maintains the ferrite beads 24 under minimum pressure to keep the beads in contact with each other and maintain the antenna core conductance. As athwart loop antenna 22 flexes, the beads 24 will maintain contact with each other while spring 34 is further compressed. This allows flexibility and crush resistance during deployment and use of the athwart loop antenna.

Figure 3:
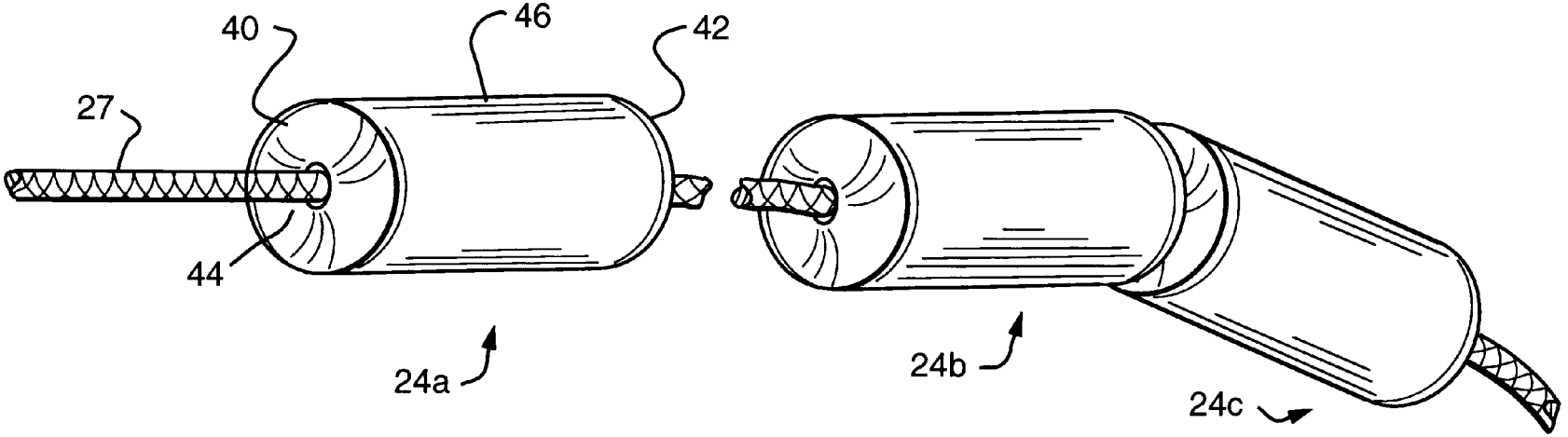
FIG. 3 is a sectional view of the core segments that form part of the present athwart loop antenna.

Each ferrite bead such as ferrite bead 24*a* of FIG. 3 is machined to be generally cylindrical or annular in shape and including exterior region 46, concave end 40 and convex end 42. Typical dimensions of each ferrite head such as 24 are 0.39" in diameter, and 0.5" long with 0.195" concave and convex regions. Hole 44 through the center of the ferrite bead 24 allows coaxial cable 27 to pass through ferrite beads. The concave tapering of end 40, and convex tapering of end 42 allow adjacent ferrite bead such as ferrite beads 24*b* and 24*c* to maintain substantial contact with each other when the cable assembly is flexed. This ensures the ferrite beads will maintain good electrical contact as the cable flexes.

Figure 4:
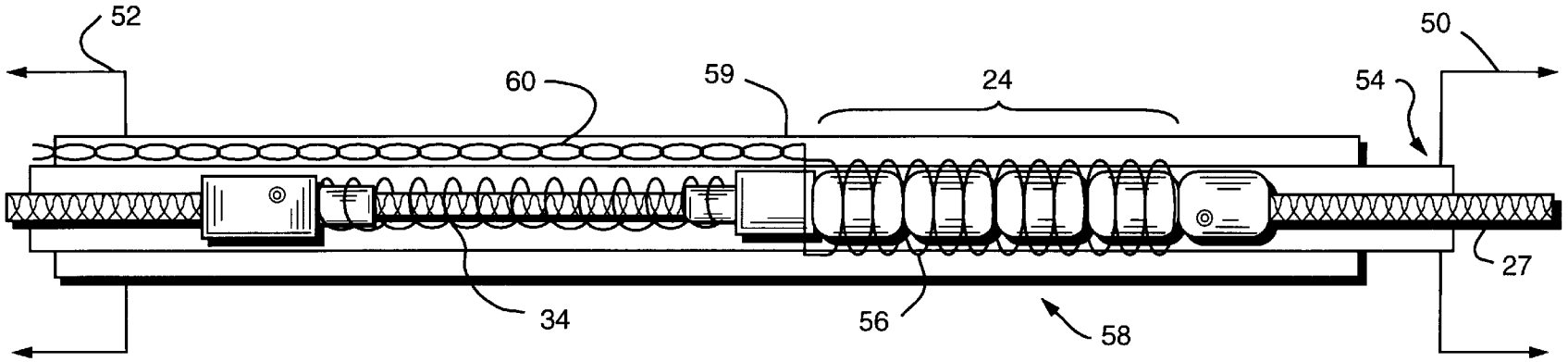
FIG. 4 is a sectional view of the athwart loop antenna encased in polyethylene.

Ferrite beads 24 are surrounded by a polyethylene tube 54 as shown in FIG. 4. Polyethylene tube 54 is etched to allow a copper wire 56 (litz wire) forming the loop antenna to be wrapped around polyethylene tube 54. The etching scribes an evenly spaced helix from start to finish and return, and allows litz wire 56 to form a helix that begins and ends at point 59 in athwart loop antenna 22, forming the loop antenna. The doubling back of the loop antenna winding helps to cancel out any signal noise from the coaxial cable passing through the center of the ferrite beads 50 not mentioned.

The signal from litz wire loop 56 is carried by twisted pair wires 60, while the signal from the horizontal wire loop amplifier is carried by coaxial cable 27. Twisted pair wire 60 carry the signal from the athwart loop antenna amplifier. Loop antenna assembly is coated with foamed polyethylene with glass balloons 58 to provide water protection and buoyancy for the cable assembly.

Figure 5:
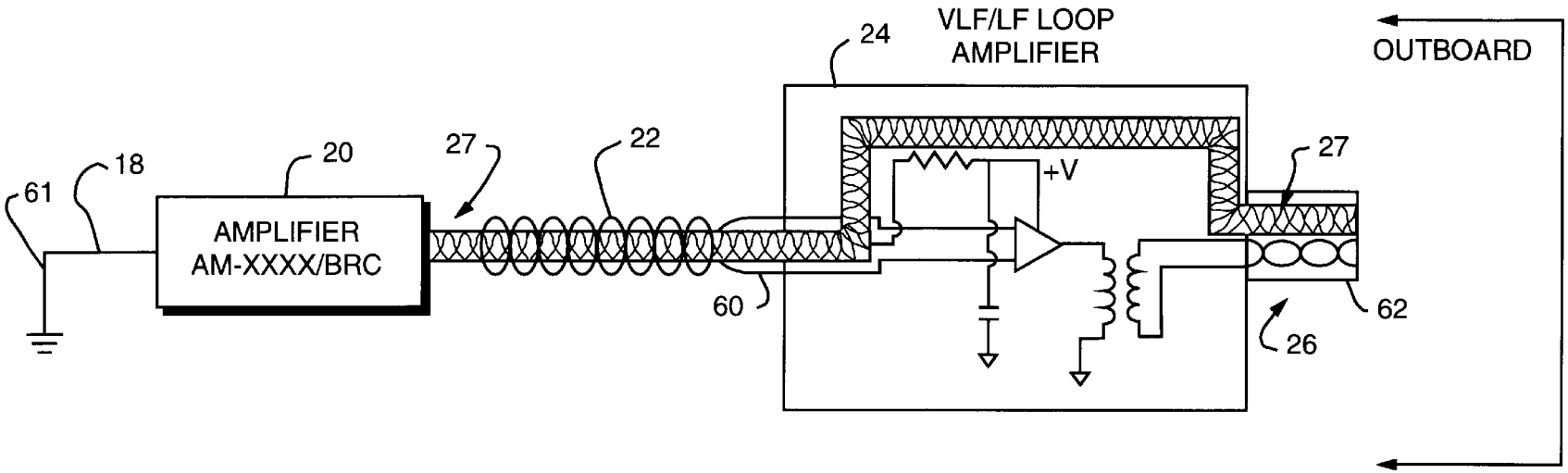
FIG. 5 is a schematic of the major elements that make up the deployable antenna cable assembly.

Horizontal wire antenna element 18, FIG. 5 is comprised of 100 feet of wire which provides an effective height of 15 millimeters at 20 kilohertz. Horizontal wire antenna element 18 is grounded at cable termination point 61, and feeds the signal into a standard type of wire antenna amplifier 20. Wire antenna amplifier 20 provides 32 decibel gain within the range of 10 to 200 kilohertz. Wire antenna amplifier 20 provides an amplified signal on coaxial cable 27.

Loop antenna 22 provides a signal on twisted pair lines 60 to a loop antenna amplifier 24. Loop antenna amplifier 24 provides 50 decibel gain at 20 kilohertz (kHz). The signals carried on coaxial cable 27 and twisted pair 62 pass through buoyant cable transmission line 26.

The novel, omni-directional cable antenna as disclosed achieves omni-directionality by combining a standard wire antenna element with a unique loop antenna element which can bend and flex during deployment and use. This allows submarines to remain submerged and undetected when they need to receive VLF/LF radio messages. The cable antenna can be deployed and retracted underwater, yet provides the omni-directionality of a mast-mounted antenna which can only be used on the surface.

Many modifications of the presently disclosed invention will become apparent to those of skill in the art without departing from the scope of the appended claims.

What is claimed is:

1. An antenna assembly comprising:

a loop antenna including a core region and a loop wire element, said core region having an exterior surface, and including a plurality of segments, each of said plurality of segments cylindrically shaped and having a first and second end, said first end of each of said cylindrically shaped segments having a generally concave surface and said second end of each of said cylindrically shaped segments having a generally convex surface, said plurality of segments disposed axially in line such that at least one generally concave surface of said first end of one of said plurality of segments is proximate a generally convex surface of said second end of a second one of said plurality of segments, and said loop wire element helically wound about said exterior surface of said core region and including a first and second wire element coupler region proximate the one end of said core region, wherein said plurality of cylindrically shaped segments have a center hole passing from said first end to said second end having a generally convex surface along a central longitudinal axis.

2. The antenna assembly as claimed in claim 1 wherein said plurality of segments comprise ferrite beads.

3. The antenna assembly as claimed in claim 1 further including a coaxial cable passing through said center hole in said plurality of cylindrically shaped segments.

4. The antenna assembly as claimed in claim 3 wherein said coaxial cable carries a signal from a straight wire antenna element.

5. The antenna assembly as claimed in claim 4 wherein said loop antenna allows reception in the athwart azimuth direction.

6. The antenna assembly as claimed in claim 3 wherein said core region includes a first and second end stop, each of said first and second end stops including a center hole with said coaxial cable passing through said center hole, wherein said first and second end stops are disposed one at each end of said core region, to contain said plurality of cylindrically shaped segments.

7. The antenna assembly as claimed in claim 6 wherein at least one of said first and second end stops includes a spring disposed axially about said coaxial cable, and between at least one of said first and second end stops and one end of said plurality of segments, to maintain said plurality of segments in contact with each other.

8. The antenna assembly of claim 1 wherein said loop wire element includes litz wire.

9. The antenna assembly as claimed in claim 1 wherein said core region includes a polyethylene tube around said plurality of cylindrically shaped segments proximate said exterior surface of said core region.

10. The antenna assembly as claimed in claim 9 wherein said loop wire element of said loop antenna is helically wound about said polyethylene tube.

11. An omni-directional, deployable cable antenna, comprising:

a fore and aft directional antenna proximate a first end of said deployable cable;

a fore and aft directional antenna amplifier, coupled to said fore and aft directional antenna and to a coaxial cable, for providing a fore and aft directional antenna signal on said coaxial cable;

an athwart loop antenna having a first and a second end, said first end of said athwart loop antenna disposed proximate said fore and aft directional antenna amplifier, said athwart loop antenna comprising a core region having an exterior surface, and including a plurality of segments, each of said plurality of segments cylindrically shaped and having a first and second end, said first end of each of said cylindrically shaped segments having a generally concave surface and said second end of each of said cylindrically shaped segments having a generally convex surface and having a center hole passing from said generally concave first end to said generally convex second end along a central longitudinal axis said plurality of segments disposed axially in line such that at least one generally concave surface of said first end of one of said plurality of segments is proximate a generally convex surface of said second end of a second one of said plurality of segments, said coaxial cable passing through said center hole of said plurality of segments;

a loop wire element helically wound about said exterior surface of said core region and including a first and second wire element coupler region proximate one end of said core region;

a loop antenna amplifier coupled to said first and second wire element coupler region;

a loop antenna transmission line, coupled to said loop antenna amplifier; and a fore and aft directional antenna and athwart loop antenna signal receiver, coupled to said antenna transmission line.

12. A buoyant, flexible antenna assembly comprising:

a loop antenna including a core region and a loop wire element, said core region having an exterior surface and a plurality of segments, each of said plurality of segments cylindrically shaped and having a first and second end, said plurality of segments disposed axially in line such that at least one first end of one of said plurality of segments is proximate said second end of a second one of said plurality of segments, and said loop wire element is helically wound about said exterior surface of said core region and including a first and second wire element coupler region proximate the one end of said core region; and a water protection and buoyancy material coating said loop wire element and said core region of said loop antenna.

13. The buoyant, flexible antenna assembly as claimed in claim 12, wherein said first end of each of said plurality of cylindrically shaped segments having a generally concave surface and said second end of each of said plurality of cylindrically shaped segments having a generally convex surface to allow adjacent segments to maintain substantial contact with each other when said antenna assembly is flexed.

14. The buoyant, flexible antenna assembly as claimed in claim 12, wherein said water protection and buoyancy material coating comprises a foamed polyethylene coating.

15. The buoyant, flexible antenna assembly as claimed in claim 14, wherein said foamed polyethylene coating further comprises glass balloons.

16. A buoyant, flexible antenna assembly comprising:

a loop antenna including a core region and a loop wire element, said core region having an exterior surface and a plurality of segments, each of said plurality of segments cylindrically shaped and having a first and second end, said plurality of segments disposed axially in line such that a surface of said first end of one of said plurality of segments is proximate a surface of said second end of a second one of said plurality of segments, and said loop wire element is helically wound about said exterior surface of said core region and including a first and second wire element coupler region proximate to one end of said core region, wherein each of said plurality of said cylindrically shaped segments have a center hole passing from said first end to said second end; and a water protection and buoyancy material coating said loop antenna.

17. The buoyant, flexible antenna assembly of claim 16 further including a co-axial cable passing through said center hole in each of said plurality of said cylindrically shaped segments.

18. The buoyant, flexible antenna assembly of claim 17 wherein said core region includes a polyethylene tube around said plurality of cylindrically shaped segments proximate said exterior surface of said core region.

19. The buoyant, flexible antenna assembly of claim 18 wherein said water protection and buoyancy material coating comprises a foamed polyethylene coating.

* * * * *